US006686886B2

(12) United States Patent
Flint et al.

(10) Patent No.: US 6,686,886 B2
(45) **Date of Patent: *Feb. 3, 2004**

(54) INTEGRATED ANTENNA FOR LAPTOP APPLICATIONS

(75) Inventors: Ephraim B. Flint, Lincoln, MA (US); Brian P. Gaucher, New Milford, CT (US); Duixian Liu, Yorktown Heights, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/866,974

(22) Filed: May 29, 2001

(65) Prior Publication Data

US 2002/0190905 A1 Dec. 19, 2002

(51) Int. Cl.[7] ..... H01Q 1/24

(52) U.S. Cl. ..... 343/702; 343/700 MS; 343/767

(58) Field of Search ..... 343/702, 767, 343/770, 700 MS, 725, 846; 455/90; H01Q 1/24

(56) References Cited

U.S. PATENT DOCUMENTS

| | | | | |
|---|---|---|---|---|
| 4,131,892 A | | 12/1978 | Munson et al. | 343/700 MS |
| 4,131,893 A | | 12/1978 | Munson et al. | 343/700 MS |
| 4,367,475 A | | 1/1983 | Schiavone | 343/767 |
| 5,138,328 A | | 8/1992 | Zibrik et al. | |
| 5,677,698 A | | 10/1997 | Snowdon | 343/702 |
| 6,307,520 B1 | * | 10/2001 | Liu | 343/767 |
| 6,339,400 B1 | * | 1/2002 | Flint et al. | 343/702 |

FOREIGN PATENT DOCUMENTS

| | | | |
|---|---|---|---|
| WO | WO 9506338 | 3/1995 | H01Q/1/22 |

OTHER PUBLICATIONS

David Pogue, "The iBook: What Steve Jobs Didn't Say." in MacWorld on the web. pp. 1–3, Jul 18, 1999.
Anonymous. Apple PowerBook G3 500 MHz Full Review. in MacWeek.com. pp. 1–2, date unknown.
Wendy J. Mattson. "Fast PowerBooks Start to Arrive,"in MacWeek.com pp. 1–2. Jun. 7, 1999.
Andy (last name unknown). "The Vision Thing: No Strings Attached," in MacWorld on the web. pp. 1–3. Jul. 18, 1999.
Anonymous, "Apple Introduces AirPort Wireless Networking," in CreativePro.com on the web, pp. 1–2, Jul. 21, 1999.
Anonymous. "Apple PowerBook G4 Technical Specifications", pp. 1–4, 2001.
Anonymous. PowerBook G4, pp. 1–4, Jan. 2001.
John D. Kraus. "Antennas", 2d Edition, McGraw–Hill, 1988. pp. 624–645.
Color Photograph of Apple®Power Book®computer showing first antenna on top left of display and second antenna on middle of right display frame, reflecting product as available on or about Jul. 26, 2000. date of product introduction unknown.
Color Photograph of Apple®Power Book®computer showing enlarged view of antenna on top left of display, reflecting product as available on or about Jul. 26, 2000, date of product introductin unknown.
Color Photograph of Apple®Power Book®computer showing enlarged view of antenna on middle of right display frame, reflecting product as available on or about Jul. 26, 2000. date of product introduction unknown.

* cited by examiner

*Primary Examiner*—Hoanganh Le
(74) *Attorney, Agent, or Firm*—F. Chau & Associates, LLP

(57) ABSTRACT

An antenna for integration into a portable processing device, comprises an electronic display metal support frame, a first and a second radiating element extending from the support frame and a conductor for conducting a signal comprising a first component for carrying a signal to the second radiating element and a second component for grounding the conductor to the support frame.

18 Claims, 10 Drawing Sheets

FRONT SIDE

BACK SIDE

INTEGRATED ANTENNA FOR LAPTOP APPLICATIONS

BACKGROUND OF THE INVENTION

1. Field of the Invention

The present invention relates to antennas, and more particularly towards a dual-band antenna for mobile computer devices.

2. Description of Prior Art

Typically, a wired cable is used by a laptop to communicate with another processing device such as another laptop, desktop, server, or printer. To communicate without a wired connection, an antenna is needed. FIG. 1 shows two possibilities of outside antennas. Antennas can be located at the top of a laptop display 100 for better radio frequency (RF) clearance, or just outside (dash line for antenna) of a Personal Computer Memory Card International Association (PCMCIA) card 101. Usually, the laptop will have an optimum wireless performance if the antenna is mounted on the top of the display 100. However, an external antenna will generally be more expensive and susceptible to damage than an internal antenna. Alternatively, an internal or embedded antenna generally will not perform as well as an external antenna. The commonly used method to improve the performance of an embedded antenna is to keep the antenna away from any metal component of the laptop. Depending on the design of the laptop and the type of antenna, the distance between the antenna and metal components could be at least 10 mm. FIG. 2 shows some possible embedded antenna implementations. Two antennas are typically used, though applications implementing one antenna are possible. In one case, the two antennas are placed on the left 200 and right 201 edge of the display. Using two antennas instead of one antenna will reduce the blockage caused by the display in some directions and provide space diversity to the communication system. As a result, the size of the laptop becomes larger to accommodate antenna placement. In another configuration, one antenna can be placed on one side (200 or 201) of the display and a second antenna on the top 202 of the display. This latter antenna configuration may also provide antenna polarization diversity depending on the antenna design used.

Advances in wireless communications technology are developing rapidly. The 2.4 GHz Instrument, Scientific, and Medical (ISM) band is widely used. As an example, many laptop computers will incorporate Bluetooth technology as a cable replacement between portable and/or fixed electronic devices and IEEE 802.11 b technology for wireless local area networks (WLAN). If an 802.11 b device is used, the 2.4 GHz band can provide up to 11 Mbps data rate. For higher data rates, the 5 GHz Unlicensed National Information Infrastructure (U-NII) band can be used. U-NII devices can provide data rates up to 54 Mbps. As a result, the demand for a dual-band antenna operating at both bands is increasing. Dual-band antennas with one feed have some advantages over multi-feed antennas for cellular applications.

As wireless communications among processing devices become increasingly popular and increasingly complex, a need exists for a compact integrated dual-band antenna having reduced costs and reliable performance.

SUMMARY OF THE INVENTION

The present invention relates to an antenna for integration into a portable processing device. According to one aspect of the invention, the antenna includes an electronic display metal support frame for grounding a conducting element, a first and a second radiating element extending from the support frame, and a conductor for conducting a signal comprising a first component for carrying a signal connected to the second radiating element and a second component for grounding the conducting means connected to the support frame.

The first and second radiating elements are concentric with the first radiating element disposed within the second radiating element. The first radiating element is one of an inverted-L antenna and a slot antenna.

The second radiating element is one of an inverted-F antenna and a slot antenna.

An impedance match is achieved by positioning a feed conductor towards a midpoint of the length of the second radiating element for increasing impedance at a lower band and towards a closed end of the length for decreasing the impedance at the lower band.

Preferably, the means for conducting the signal is a coaxial cable having an inner feed conductor connected to the second radiating element and an outer conductor connected to the support frame.

The first and second radiating elements are disposed substantially along a plane of the support frame. The first and second radiating elements are substantially transversely disposed on the support frame.

The antenna includes a duplexer connected to two communications systems and the dual-band antenna for transmitting at two bands simultaneously.

According to an embodiment of the present invention, an integrated antenna arrangement is provided including a conductive RF shielding foil disposed on the back of an electronic display having an integrated dual-band antenna, and a feed portion extending partially across a hole forming a slot antenna.

The antenna arrangement further includes means for conducting a signal comprising a first component for conducting the signal connected to the feed portion and a second component for grounding the conducting means connected to the RF foil opposite the feed portion.

The means for conducting the signal is a coaxial cable having an inner conductor connected to the feed portion and an outer conductor connected to the RF foil opposite the feed portion.

An impedance match is achieved by positioning a feed conductor towards a midpoint of the length of the antenna arrangement for increasing impedance and towards an end of the length for decreasing the impedance.

Preferably, the antenna arrangement further comprises means for conducting a signal comprising a first component for conducting the signal connected to the feed portion and a second component for grounding the conducting means connected to the RF foil opposite the feed portion. The means for conducting the signal is a coaxial cable having an inner conductor connected to the feed portion and an outer conductor connected to the RF foil opposite the feed portion.

An impedance match is achieved by positioning a feed conductor at an open end of the length of the antenna arrangement for increasing impedance and towards a closed end of the length for decreasing the impedance electronic display metal support frame for grounding a conducting element, a pair of radiating elements extending from the display frame, and a means for conducting a dual-band signal comprising a first component for carrying a signal connected to the first and second radiating elements and a second component for grounding the conducting means connected to the display frame.

BRIEF DESCRIPTION OF THE DRAWINGS

Preferred embodiments of the present invention will be described below in more detail, with reference to the accompanying drawings.

DETAILED DESCRIPTION OF PREFERRED EMBODIMENTS

The antenna according to an embodiment of the present invention is designed for the ISM and U-NII band applications, but can be used for other applications- such as dual-band cellular applications. According to an embodiment of the present invention, dual-band antenna performance is achieved by adding a radiating element inside a signal band antenna. As a result, the size of a dual-band antenna according to the present invention may be no larger than a single band antenna. A dual-band antenna is capable of operating in either of two frequencies, for example, 800 MHz and 1900 MHz, 2.45 GHz and 5 GHz, etc.

Figure 1:
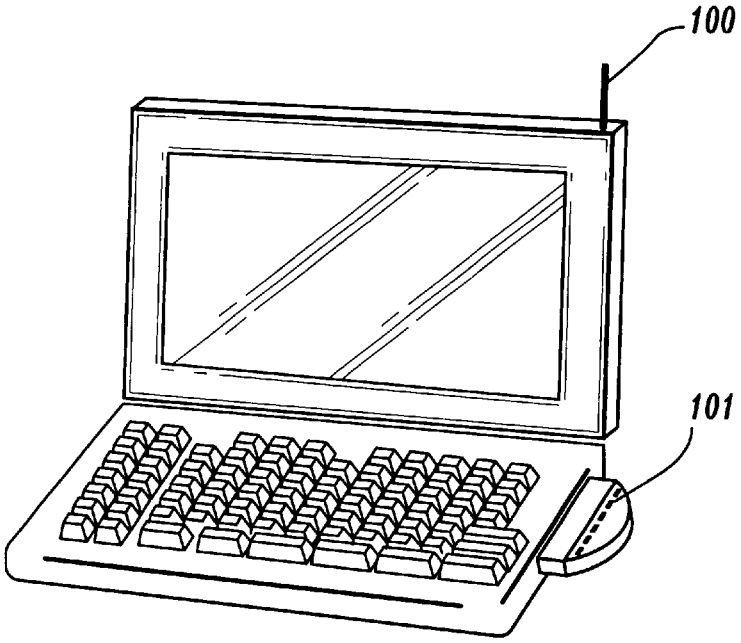
FIG. 1 (Prior Art)
FIG. 1 illustrates a laptop computer with external antennas.
Figure 2:
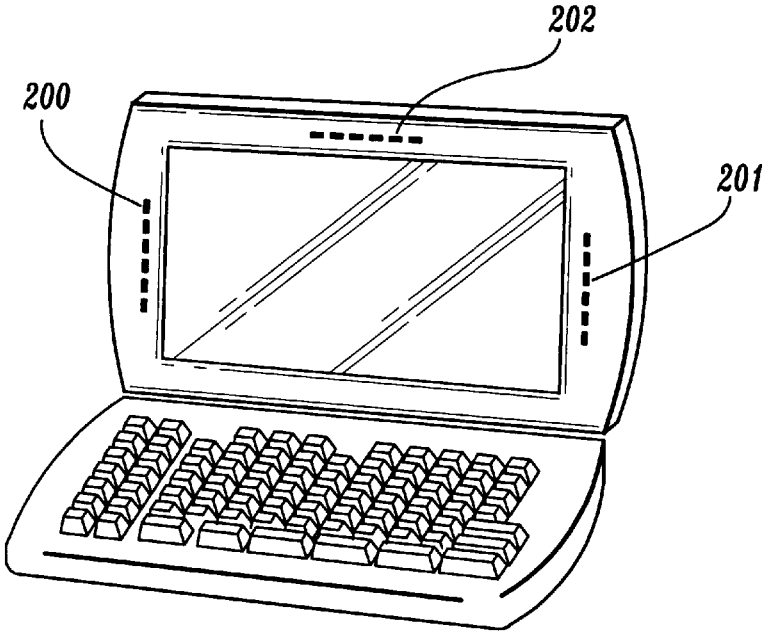
FIG. 2 (Prior Art)
FIG. 2 illustrates a laptop computer with slot embedded antennas.
Figure 3:
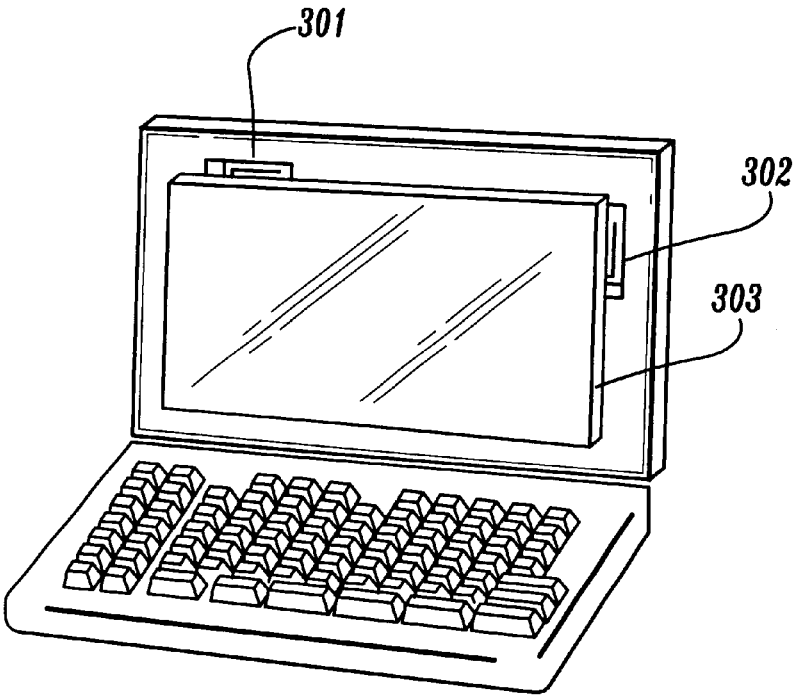
FIG. 3 illustrates two slot dual-band antennas disposed along a plane of the display frame according to an embodiment of the present invention.
Figure 4:
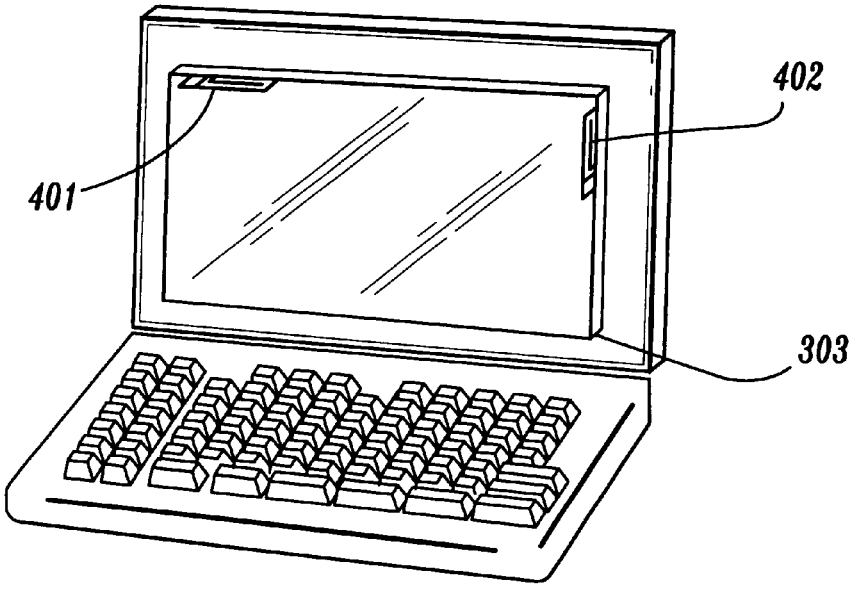
FIG. 4 illustrates two slot dual-band antennas transversely disposed on the display frame according to an embodiment of the present invention.

FIG. 3 illustrates two dual-band antennas parallel 301–302 to the display frame, disposed substantially along the plane of the support frame, in the x-y (width-height) plane. FIG. 4 illustrates two dual-band antennas perpendicular 401–402 to the support frame, substantially transversely disposed (in a z plane relative to the x-y plane) on the support frame. Each antenna is mounted on a display frame 303. Metal supports and/or RF shielding foil on the back of the display 303 can be included as part of an antenna. Parallel or perpendicular antennas may be implemented depending on the industrial design needs. The parallel and perpendicular antennas have similar performances. Further, the various antennas may be implemented together, for example, a parallel inverted-F antenna and a perpendicular slot antenna mounted on the same device.

Figure 5:
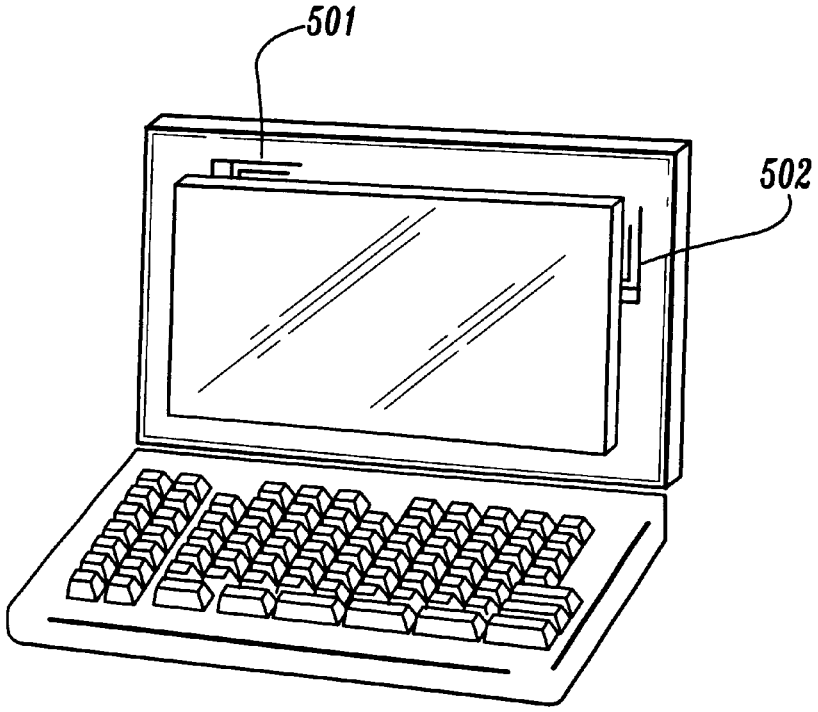
FIG. 5 illustrates two inverted-F dual-band antennas along the plane of the display frame according to an embodiment of the present invention.
Figure 6:
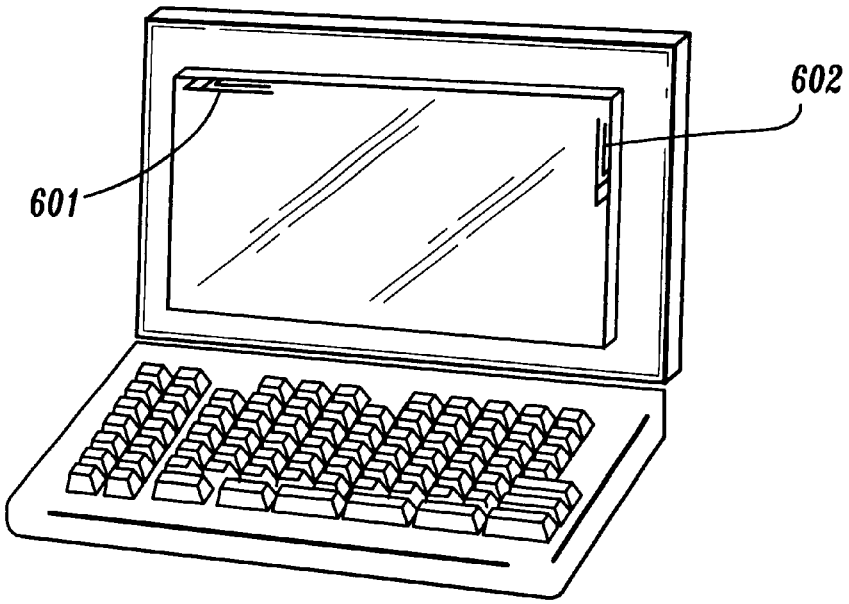
FIG. 6 illustrates two inverted-F dual-band antennas transversely disposed on the display frame according to an embodiment of the present invention.

For applications where space may be limited, a dual-band inverted-F antenna, e.g., 501–502 and 601–602 may be used as shown in FIGS. 5 and 6. The inverted-F antenna is about half the length of a slot antenna. At the lower frequency band, the inverted-F antenna has wide standing wave ratio (SWR) bandwidth, but the gain value is usually lower than that of the slot antenna. For both slot and inverted-F version dual-band antennas, impedance match is achieved by moving the feed line toward the center to increase impedance or toward the end to decrease the impedance at the lower band.

Figure 7:
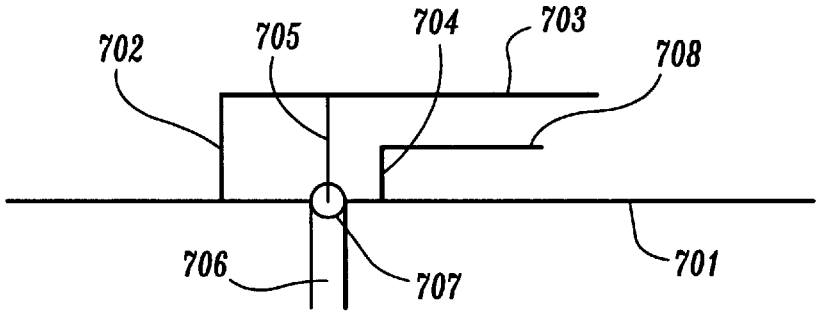
FIG. 7 illustrates an inverted-F dual-band antenna according to an embodiment of the present invention.

Referring to FIG. 7, an inverted-F dual-band antenna according to an embodiment of the present invention includes a ground plate 701 provided by the laptop display frame, a metal support structure or other RF shielding foil on the back of the display. The dual-band antenna, including inter alia, 702–704 and 708, may be formed of a single thin wire or stamped from a metal sheet. The inner conductor 705 of the coaxial cable 706 is also illustrated. The outside metal shield 707 of the coaxial cable 706 is connected to the ground plate 701. The antenna structures presented in this invention can be easily implemented on a printed circuit board (PCB).

Figure 8:
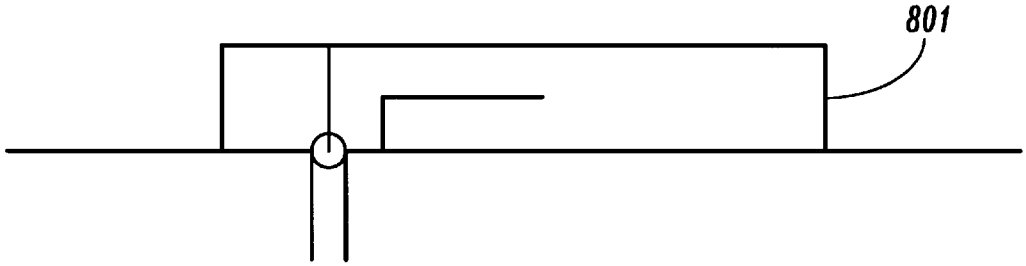
FIG. 8 illustrates a slot dual-band antenna according to an embodiment of the present invention.

FIG. 8 illustrates a general configuration of the slot dual-band antenna according to an embodiment of the present invention. The slot dual-band antenna includes the elements of the inverted-F antenna and additionally element 801 closing an outside loop.

Figure 9:
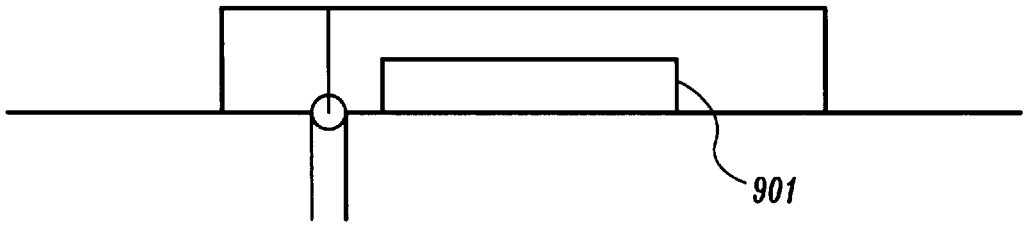
FIG. 9 illustrates a slot-slot dual-band antenna according to an embodiment of the present invention.

FIG. 9 illustrates a general configuration of a slot-slot dual-band antenna according to an embodiment of the present invention. The slot-slot dual-band antenna includes the elements of the slot antenna and additionally element 901 closing an inside loop.

Figure 10:
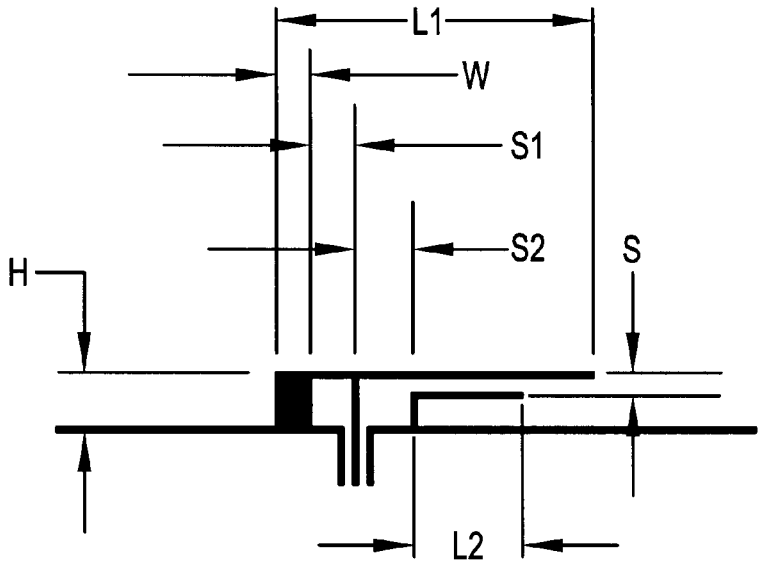
FIG. 10*a* illustrates the operation of an inverted-F dual-band antenna according to an embodiment of the present invention.
FIG. 10*b* illustrates the operation of an inverted-F dual-band antenna according to an embodiment of the present invention.
Figure 10A:
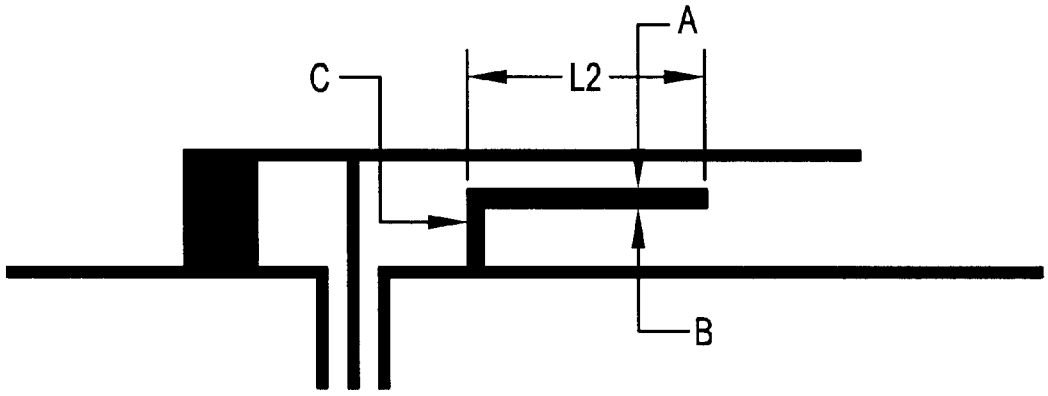

FIG. 10*a* illustrates an operation principle of the inverted-F version dual-band antenna. H+L1 is about one quarter wavelength at the center of the lower frequency band. Increasing S1 (moving the feed line to the right) will increase the input impedance of the antenna at the lower band. Making W narrower will achieve the same effect. Increasing the length of L1 will reduce the resonate frequency at the lower band. L2+(H−S) is about one quarter wavelength long at the center of the high band. Separations S and S2 determine the input impedance match of the antenna at the high band. Referring to FIG. 10*b*, generally speaking, impedance can be changed according to the following relationships at the high band: moving edge A up to increase the impedance; moving edge B down to decrease the impedance; and moving edge C to the left or towards the feed to increase the impedance. Making the line strips wide and H larger will increase the bandwidths of the antenna at both bands.

For a dual-band antenna according to the present invention, the input impedance match is effected by factors including, inter alia, the separations S and S2 as well as the height H. Further, the band of the antenna can affect the relationships, for example, the relationships observed for a 2.4 GHz band antenna may not be the same as the relationships observed for a 5 GHz band antenna. Therefore, determining the input impedance match for a dual-band antenna according to the present invention can be done according to experimentation. The experimentation and relationships for different antennas would be obvious to one skilled in the art in light of the present invention.

Figure 11:
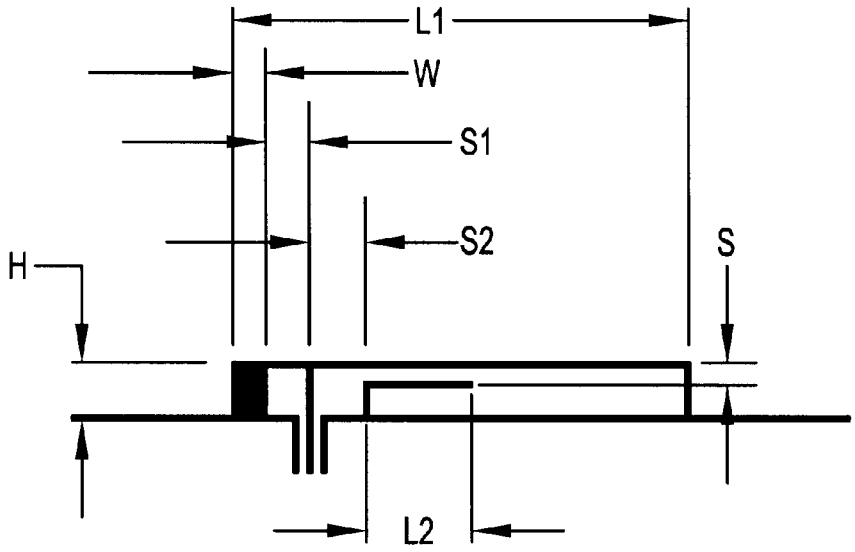
FIG. 11 illustrates the operation of a slot dual-band antenna according to an embodiment of the present invention.

Referring to FIG. 11, an operation principle of the slot version dual-band antenna is shown. In this case, 2H+L1 is about one half wavelength at the center of the lower frequency.

Figure 12:
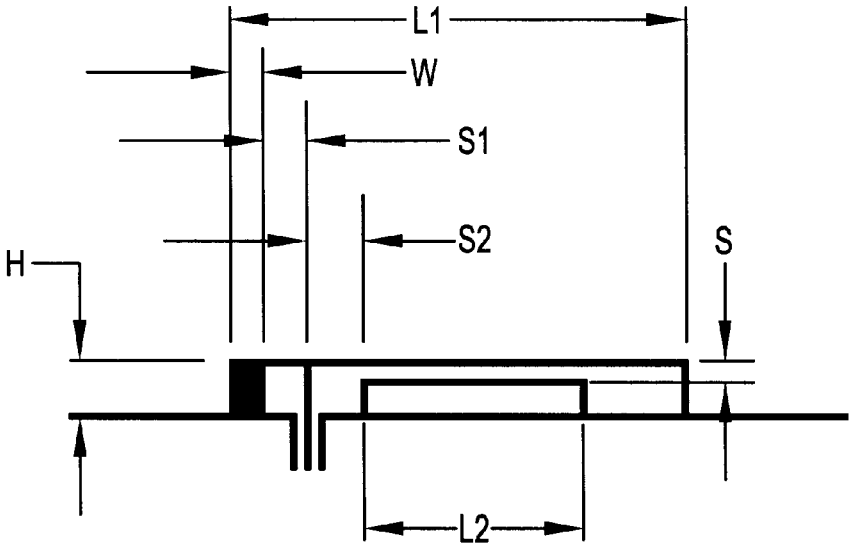
FIG. 12 illustrates the operation of a slot-slot dual-band antenna according to an embodiment of the present invention.

Referring to FIG. 12, an operation principle of the slot-slot version dual-band antenna is shown. In this case, 2H+L1 is about one half wavelength at the center of the lower frequency band, while L2+2(H−S) is about one half wavelength long at the center of the high band.

The antenna impedance and resonate frequencies in antenna structures in FIGS. 11 and 12 are tuned in the same way as described with respect to FIG. 10.

Figure 13:
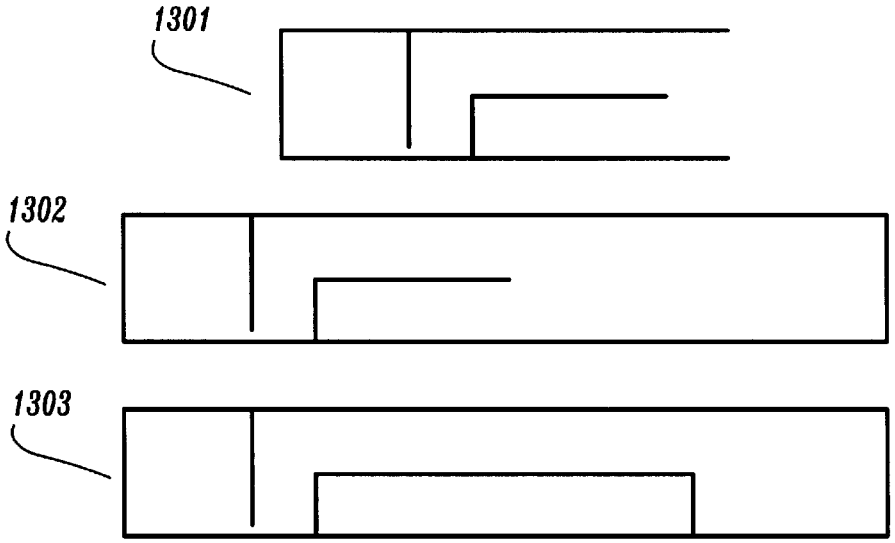
FIG. 13 illustrates possible configurations of an antenna according to an embodiment of the present invention.

FIG. 13 shows possible antenna constructions stamped from a metal sheet or fabricated PCB. These including the inverted-F antenna 1301, the slot antenna 1302, and the slot-slot antenna 1303.

Figure 14:
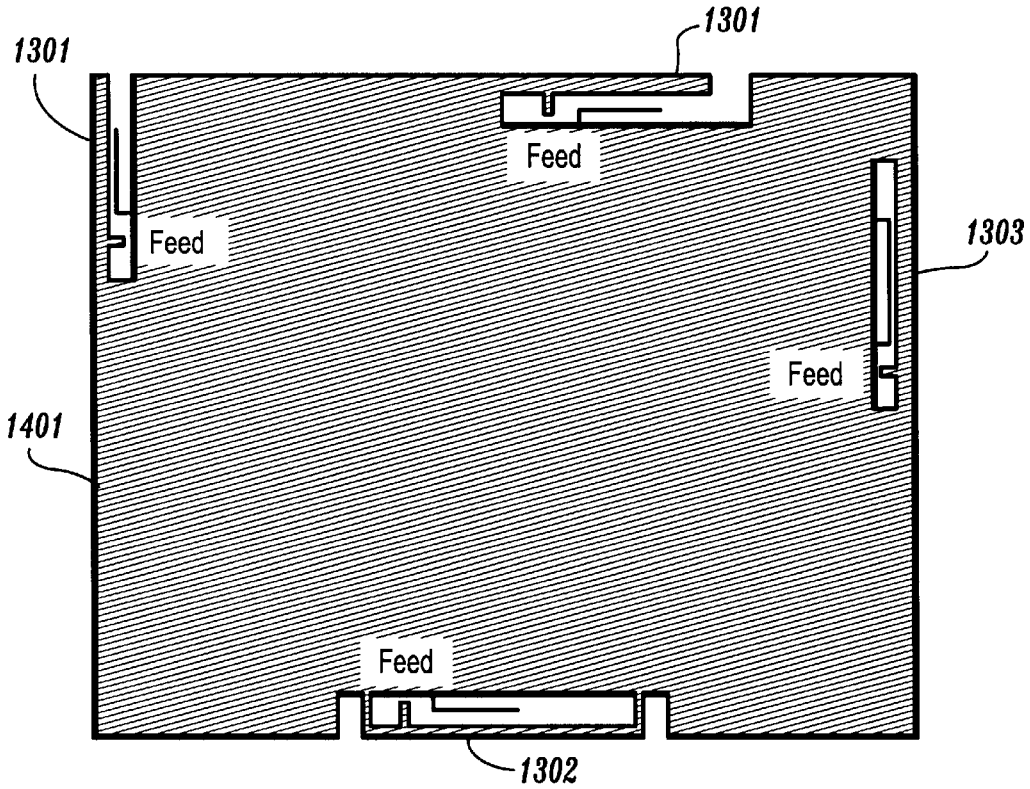
FIG. 14 illustrates possible configurations of an antenna built on an RF foil according to an embodiment of the present invention.

FIG. 14 shows examples of slot, slot-slot, and inverted-F dual-band antennas according to FIG. 13 built on the RF shielding foil 1401 on the back of a display. To ensure the antennas built of RF shielding foil have desirable efficiency, the foil material should have good conductivity, such as that of aluminum, copper, brass, or gold.

Figure 15:
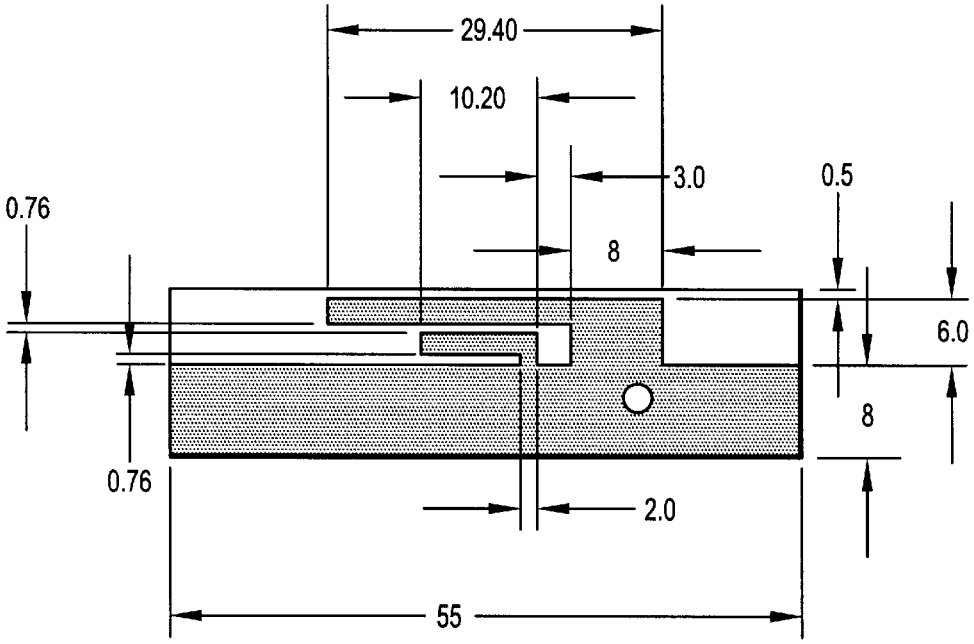
FIG. 15 illustrates a PCB implementation according to an embodiment of the present invention.
Figure 15:
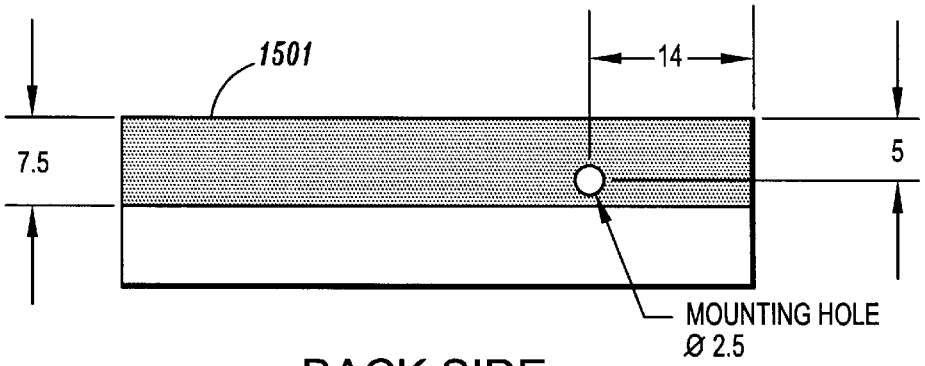

According to an embodiment of the present invention, dual-band antennas can be fabricated on, for example, a 0.01" GETEK PCB. The GETEK PCB substrate has, for example, 3.98 dielectric constant and 0.014 loss tangent measured from 0.3 GHz to 6 GHz. FIG. 15 is an illustrative example of a dual-band antenna fabrication on GETEK PCB. While a double-sided PCB is shown, a single-sided PCB can also be used. Removing the strip on the backside 1501 will not affect the antenna performance. The strip can be made of any conductive material, for example, copper.

Figure 16:
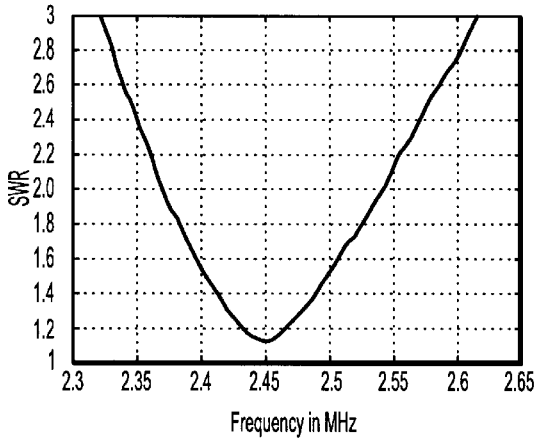
FIG. 16 is a graph illustrating the measured SWR at 2.4 GHz band according to an embodiment of the present invention.
Figure 17:
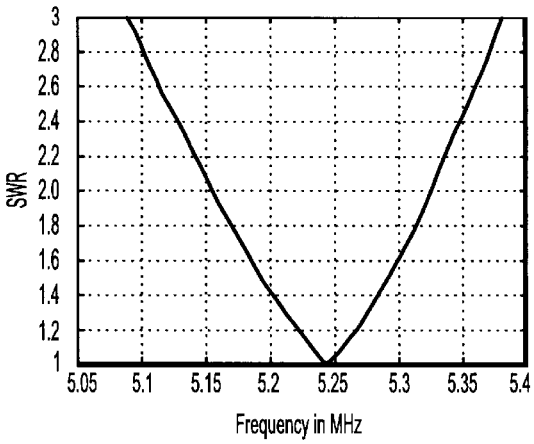
FIG. 17 is a graph illustrating the measured SWR at 5 GHz band according to an embodiment of the present invention.

FIGS. 16 and 17 show the measured SWR of the antenna at 2.4 GHz and 5 GHz bands respectively. The antenna has enough 2:1 SWR bandwidth to cover the 2.4 GHz band (2.4–2.5 GHz) completely. The 2:1 SWR antenna bandwidth at the 5 GHz band (5.15–5.35 GHz) covers a majority of the band. However, the band can be completely covered with optimization.

Table 1 shows the measured dual-band antenna gain values at different frequencies.

TABLE 1

| 2.4 GHz | | | | | |
|---|---|---|---|---|---|
| Freq. (GHZ) | 2.35 | 2.4 | 2.45 | 2.5 | 2.55 |
| Ave/Peak Gains (dBi) | −1.8/1.8 | −0.9/1.7 | −0.5/2.3 | −0.6/2.4 | −1.4/2.0 |
| 5 GHz | | | | | |
| Freq. (GHz) | −5.05 | 5.15 | 5.25 | 5.35 | 5.45 |
| Ave/Peak Gains (dBi) | −0.7/3.2 | −0.7/2.9 | −1.0/3.3 | −1.7/3.3 | −2.9/1.9 |

Figure 18:
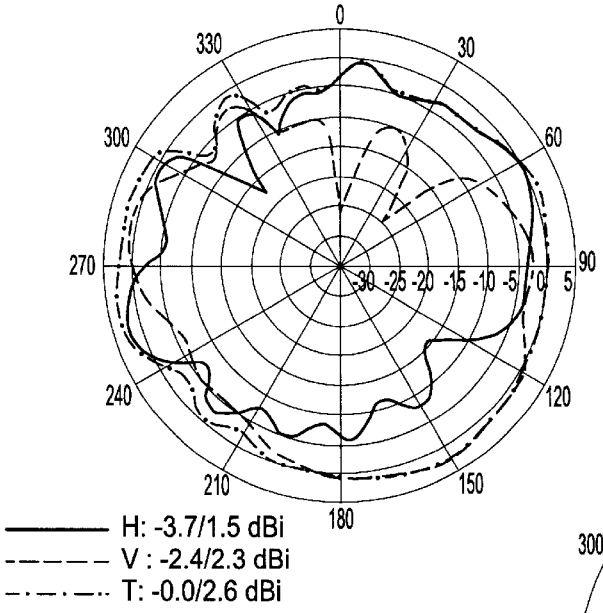
FIG. 18 is a graph illustrating the measured radiation patterns at 2.45 GHz according to an embodiment of the present invention.
Figure 19:
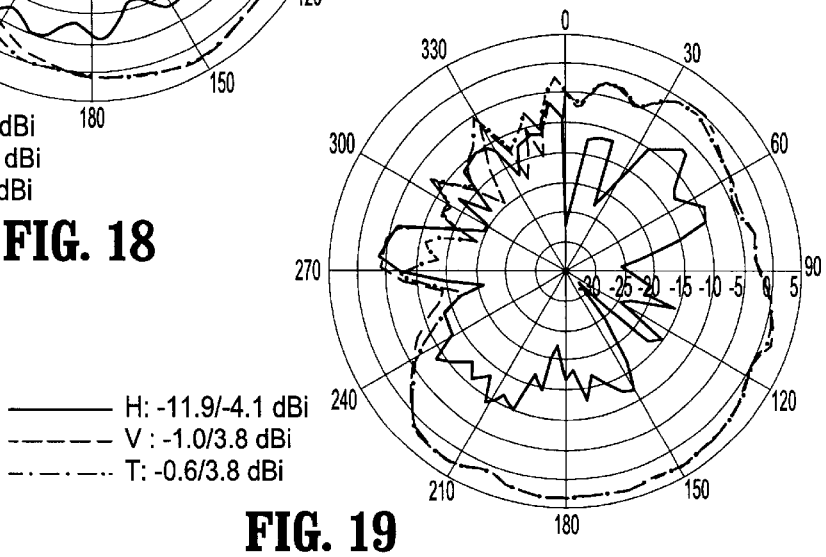
FIG. 19 is a graph illustrating the measured radiation patterns at 5.25 GHz according to an embodiment of the present invention.

FIGS. 18 and 19 show the horizontal plane radiation patterns at 2.45 GHz and 5.25 GHz respectively. The antenna at 2.45 GHz has both vertical and horizontal polarization, but it has a substantially vertical polarization at 5.25 GHz band. The effect of the laptop display on the radiation patterns is obvious. The solid line is for the horizontal polarization, the dash line is for the vertical polarization, and the dash-dot line is the total radiation pattern. In the radiation patterns, H, V, and T refer to the horizontal, vertical and total electrical fields respectively. In the legend of FIG. 18 and FIG. 19, the number before the slash (/) is the average gain value while the number after the slash (/) is the peak gain values on the horizontal plane.

Figure 20:
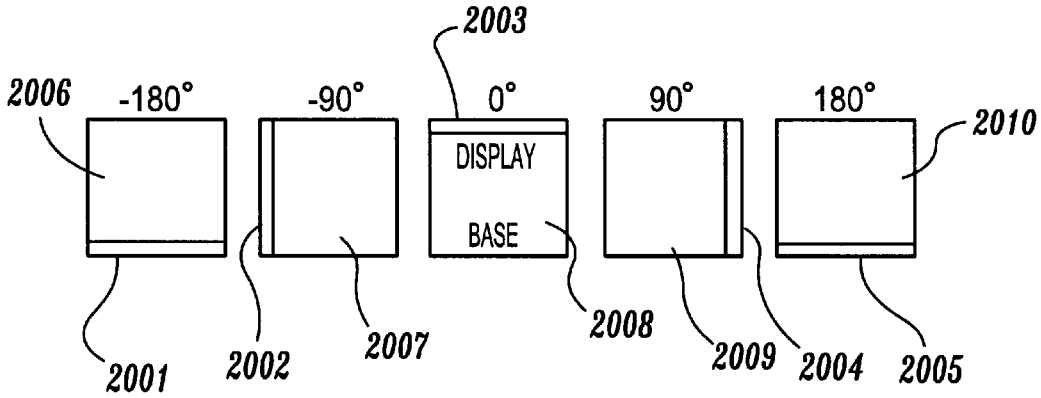
FIG. 20 illustrates the orientation of the antenna for radiation pattern measurements in FIGS. 18 and 19.

FIG. 20 shows laptop orientation (top view) corresponding to the radiation measurements shown in FIGS. 18 and 19 when the laptop is open and the angle between the display 2001–2005 and the base 2006–2010 is 90 degrees.

Figure 21:
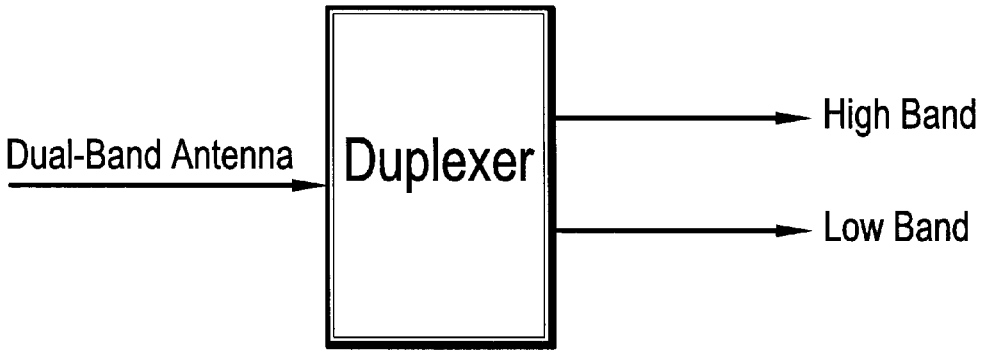
FIG. 21 illustrates a duplexer according to an embodiment of the present invention.

Referring to FIG. 21, using a dual-band antenna and a duplexer, for example, implemented on a printed circuit board, two communications systems can work simultaneously. For laptop applications, the low band for Bluetooth (IEEE 802.11 b) at the 2.4 GHz ISM band and the high band for IEEE 802.11 a at U-NII band. Other combinations would be obvious to one skilled in the art in light of the present invention.

Having described preferred embodiments of an integrated dual-band antenna for laptop applications, it is noted that modifications and variations can be made by persons skilled in the art in light of the above teachings. It is therefore to be understood that changes may be made in the particular embodiments of the invention disclosed which are within the scope and spirit of the invention as defined by the appended claims.

What is claimed is:

1. A dual-band antenna for integration into a portable processing device, comprising:

an electronic display metal support frame;

a first and a second radiating element extending from the support frame, the first radiating element having a resonant frequency in a first frequency band, and the second radiating element having a resonant frequency in a second frequency band; and a conductor for conducting a signal comprising a first component for carrying a signal to the second radiating element and a second component for grounding the conductor to the support frame.

2. The antenna of claim 1, wherein the first and second radiating elements are concentric with the first radiating element disposed within the second radiating element.

3. The antenna of claim 1, wherein the first radiating element is one of an inverted-L antenna and a slot antenna.

4. The antenna of claim 1, wherein the second radiating element is one of an inverted-F antenna and a slot antenna.

5. The antenna of claim 4, wherein an impedance match is achieved by positioning a feed conductor towards a midpoint of the length of the second radiating element for increasing impedance at a lower band and towards a closed end of the length for decreasing the impedance at the lower band.

6. The antenna of claim 1, wherein the conductor is a coaxial cable, wherein the first component is an inner feed conductor connected to the second radiating element and the second component is an outer conductor connected to the support frame.

7. The antenna of claim 1, wherein the first and second radiating elements are disposed substantially along a plane of the support frame.

8. The antenna of claim 1, wherein the first and second radiating elements are substantially transversely disposed on the support frame.

9. The antenna of claim 1, further comprising a duplexer connected to two communications systems and the dual-band antenna for transmitting at two bands simultaneously.

10. The antenna of claim 1, wherien the second radiating element is connected to ground.

11. An integrated antenna arrangement comprising:

a conductive RF shielding foil disposed on the back of an electronic display having a notch forming a first radiating element of an integrated dual-band antenna comprising the first radiating element and a second radiating element; and a feed portion extending from the first radiating element, wherein the integrated dual-band antenna is a slot antenna.

12. The antenna arrangement of claim 11, further comprising means for conducting a signal comprising a first component for conducting the signal connected to the feed portion and a second component for grounding the means for conducting to the RF foil opposite the feed portion.

13. The antenna arrangement of claim 12, wherein the means for conducting the signal is a coaxial cable having an inner conductor connected to the feed portion and an outer conductor connected to the RF foil opposite the feed portion.

14. The antenna arrangement of claim 11, wherein an impedance match is achieved by positioning a feed conductor towards a midpoint of the length of the antenna arrangement for increasing impedance and towards an end of the length for decreasing the impedance.

15. An integrated antenna arrangement comprising:

a conductive RF shielding foil disposed on the back of an electronic display comprising a first interior surface, a second interior surface and a third interior surface, wherein the first and second interior surfaces are parallel and the third interior surface is perpendicular to the first and second interior surfaces, wherein the third interior surface couples the first and second interior surfaces, wherein at least the first interior surface is a first radiating element;

a feed portion extending from the first radiating element;

a second radiating element extending from the second surface, wherein at least a portion of the second radiating element is encompassed by the first radiating element.

16. The integrated antenna arrangement of claim 15, wherein the integrated antenna is an inverted-F dual-band antenna.

17. The integrated antenna arrangement of claim 15, further comprising a fourth interior surface parallel to the third interior surface and coupling the first and second interior surfaces, wherein the integrated antenna is one of a slot antenna and a slot-slot antenna.

18. The integrated antenna arrangement of claim 15, further comprising a conductor for conducting a signal comprising a first component for carrying a signal to the feed portion of the first radiating element and a second component for grounding the conductor to the conductive RF shielding foil.

* * * * *